US006863434B2

(12) United States Patent
Mojon

(10) Patent No.: US 6,863,434 B2
(45) Date of Patent: Mar. 8, 2005

(54) CONSTANT-FORCE DEVICE

(75) Inventor: Jean-François Mojon, Les Hauts-Geneveys (CH)

(73) Assignee: Richemont International S.A., Villars-sur-Glane (CH)

( * ) Notice: Subject to any disclaimer, the term of this patent is extended or adjusted under 35 U.S.C. 154(b) by 93 days.

(21) Appl. No.: 10/304,849

(22) Filed: Nov. 27, 2002

(65) Prior Publication Data

US 2003/0112709 A1 Jun. 19, 2003

(30) Foreign Application Priority Data

Dec. 15, 2001 (EP) ..... 01129893

(51) Int. Cl.[7] ..... G04B 15/00
(52) U.S. Cl. ..... 368/127; 368/124
(58) Field of Search ..... 368/124–133

(56) References Cited

U.S. PATENT DOCUMENTS 1,535,286 A * 4/1925 Bates ..... 368/130
3,583,152 A * 6/1971 Lawson ..... 368/132
3,708,974 A * 1/1973 Fujimori ..... 368/128
3,826,076 A * 7/1974 Tuetey ..... 368/129
4,122,663 A * 10/1978 Kock ..... 368/112
4,203,281 A * 5/1980 Beguin ..... 368/124
5,838,641 A * 11/1998 Tohkoku et al. ..... 368/127
6,402,368 B1 * 6/2002 Grimm et al. ..... 368/127
6,749,333 B2 * 6/2004 Scheufele ..... 368/127

FOREIGN PATENT DOCUMENTS

CH 120028 8/1927
CH 148185 11/1931

OTHER PUBLICATIONS

Yves Droz et al., "Les Remontoirs D'Égalité et les Forces Constantes dans la Montre," pp. 35–54.

* cited by examiner

*Primary Examiner*—Kamand Cuneo
*Assistant Examiner*—Jeanne-Marguerite Goodwin
(74) *Attorney, Agent, or Firm*—Young & Thompson

(57) ABSTRACT

A constant-force device for precise regulation of mechanical watch movements by means of a uniform transmission of force from the escape wheel to the regulating organ of the watch, this device being adapted to be integrated into a Tourbillon mechanism.

11 Claims, 4 Drawing Sheets

CONSTANT-FORCE DEVICE

BACKGROUND OF THE INVENTION

The present invention relates to a constant-force device for the precise regulation of mechanical watch movements by the uniform transmission of force from the escape wheel to the regulating organ of the watch, this device being adapted to be integrated into a Tourbillon mechanism.

DESCRIPTION OF THE RELATED ART

Constant-force devices in general have been known for quite some time, and are realized in most cases by an additional spring which, at any given point in time, has a certain amount of pre-tension compensating for the variable clockwork drive of a watch caused by fading tension of the mainspring and is periodically re-tensioned by a certain constant amount. While its tension is consumed in order to maintain the oscillations of the regulating organ of the watch, the force transmitted can be regarded as being far more constant than in the case of the regulating organ being driven solely by the mainspring.

The article "Les remontoirs d'égalité et les forces constantes dans la montre" written by Messrs Y. Droz and J. Flores discusses a watch having a constant-force device of the kind explained above. In this case the escape wheel is controlled by a first anchor and is periodically released, as is generally practiced with anchor escapements. At the same time the escape wheel is engaged via a pinion with a so-called constant wheel, and via a Reuleaux cam it additionally controls a second anchor itself engaged with a stop wheel. This stop wheel is concentric with said constant wheel transmitting an approximately constant torque to the regulating organ, while a pre-tensioned helical spring is placed between these wheels, this spring being subjected to said periodical re-tensioning by the mutual angular displacement of these wheels. This tension can be consumed under the control of the first anchor that is exerted via the escape wheel and the pinion, so as to maintain the oscillations of the regulating organ, and reestablished at a time determined by the second anchor. However, the concentric arrangement of the stop wheel relative to the wheel that transmits the approximately contant torque produces difficulties, both with respect to design and with respect to function.

The patent document CH 120,028 also outlines such a constant-force device where the pre-tensioned additional spring is found between the stop wheel and the escape wheel that is concentric with this stop wheel. In this case the escape wheel retransmits an approximately constant torque to the regulating organ. Despite the conceptional differences of the device and a different arrangement of the associated anchors, an approximately constant torque is transmitted on the basis of essentially the same principle as in the above design. While conventional constant-force devices of this kind certainly provide improvements, such as an escapement that is no longer influenced by the inertia of the clockwork, the possibility to sound the clockwork in the full rhythm of seconds when using appropriate design, and particularly the transmission of a relatively constant torque, yet different disadvantages are present in them. These conventional constant-force devices firstly have the disadvantage that the torque transmitted is only approximately constant, not entirely constant, insofar as even the tension of the additional spring will decay while no correction for this effect is provided in said devices. Therefore, the conventional use of an additional spring that is periodically re-tensioned provides an improved regulation of the movement but not an optimum regulation. Further, diverse difficulties arise owing to the concentric arrangement of the stop wheel and the wheel transmitting the constant torque. An arrangement that is not concentric would allow a free selection, both of the relative position of these wheels and—where the constant-force device is integrated into a Tourbillon mechanism—of the stop wheel's position relative to a so-called fixed wheel of seconds, while the stop wheel in addition could be engaged with a second wheel of different diameter. Moreover, this will simplify the design of the device in the sense that the wheels concerned need not be placed on one axle. Finally, the isolated use of a constant-force device is disadvantageous insofar as a combination with other devices aiming at a precise regulation of the movement, such as a Tourbillon mechanism, will yield a substantially improved effect.

SUMMARY OF THE INVENTION

It is the aim of the present invention to overcome the difficulties pre-cited, and in particular to transmit a truly constant torque to the regulating organ of the watch, and to allow for the advantages resulting from a stop wheel that is not concentric relative to the wheel transmitting the constant torque and from an integration into a Tourbillon mechanism.

BRIEF DESCRIPTION OF THE DRAWING

Further advantages arise from the characteristics formulated in the dependent claims and from the following description presenting the invention in greater detail with the aid of the drawings.

The appended drawings represent by way of example one embodiment of a constant-force device according to the present invention.

DESCRIPTION OF THE PREFERRED EMBODIMENTS

Figure 1:
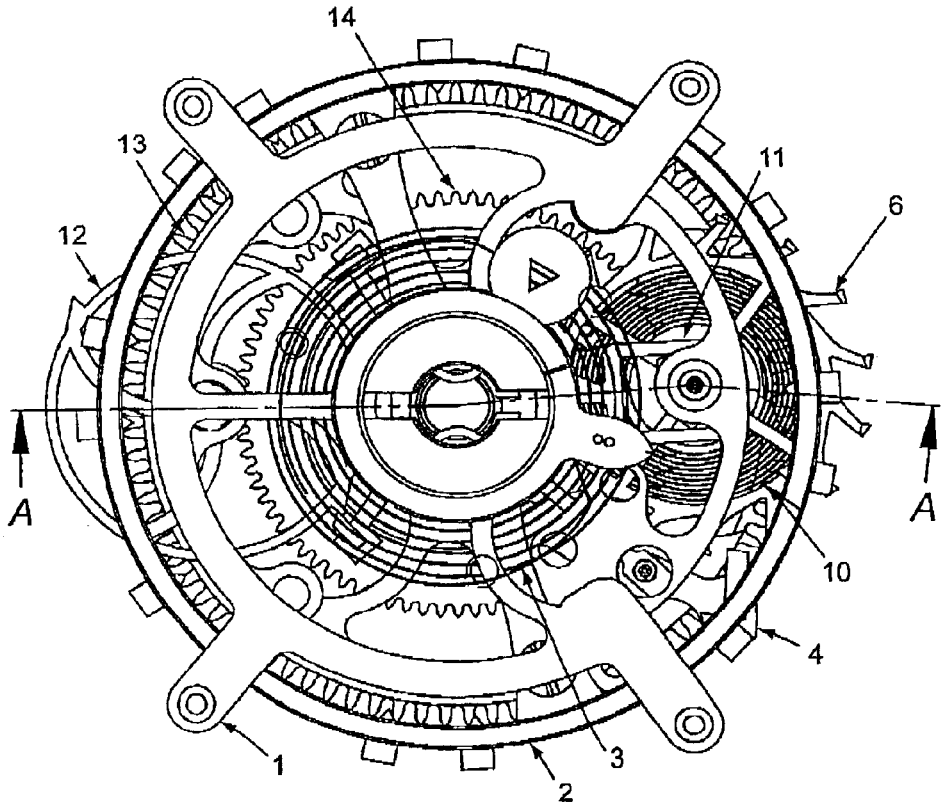
FIG. 1 is a top view of a Tourbillon mechanism provided with a constant-force device according to the invention.

In the following, this embodiment of the device will be explained in detail as an example while referring to the drawings cited above.

Integrated into the Tourbillon mechanism represented in FIG. 1 there is a constant-force device according to the present invention. The Tourbillon mechanism includes a Tourbillon cage 1, with a balance wheel 2 rotatably mounted in its center, a helical spring 3, a drive gear 13 as well as a fixed wheel of seconds 14 and, in certain cases, a second fixed wheel of seconds that is not shown and that is concentric to the first one, and has another number of teeth or another diameter.

The fixed wheel of seconds 14 or, when present, the second fixed wheel of seconds is engaged with a stop wheel pinion 12*a* that is solidly linked with the stop wheel 12 and is mounted eccentrically and rotatably within the Tourbillon cage. In the embodiment represented here, this stop wheel 12 has two teeth cooperating with the anchor pallets 11*a* and 11*b* of a second anchor 11 of the constant-force device that in the example represented is mounted so as to pivot in the axis of the Tourbillon mechanism. Said anchor 11 is controlled by a Reuleaux cam 5 via a fork-shaped part 11*c* of this anchor 11 that is opposite to the anchor pallets 11*a* and 11*b*, this Reuleaux cam 5 having the shape of a unilateral triangle with sides that are circular segments rather than straight lines. These three sides of the Reuleaux cam 5 cooperate in the traditional fashion with the fork-shaped part 11*c* of anchor 11 so as to control the pivoting movements of this anchor.

Figure 2:
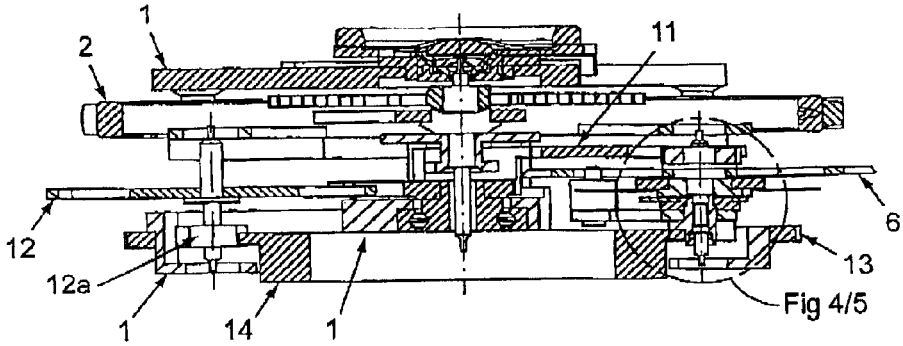
FIG. 2 shows the Tourbillon mechanism together with the constant-force device in a sectioned view taken along the line A—A of FIG. 1.
Figure 3:
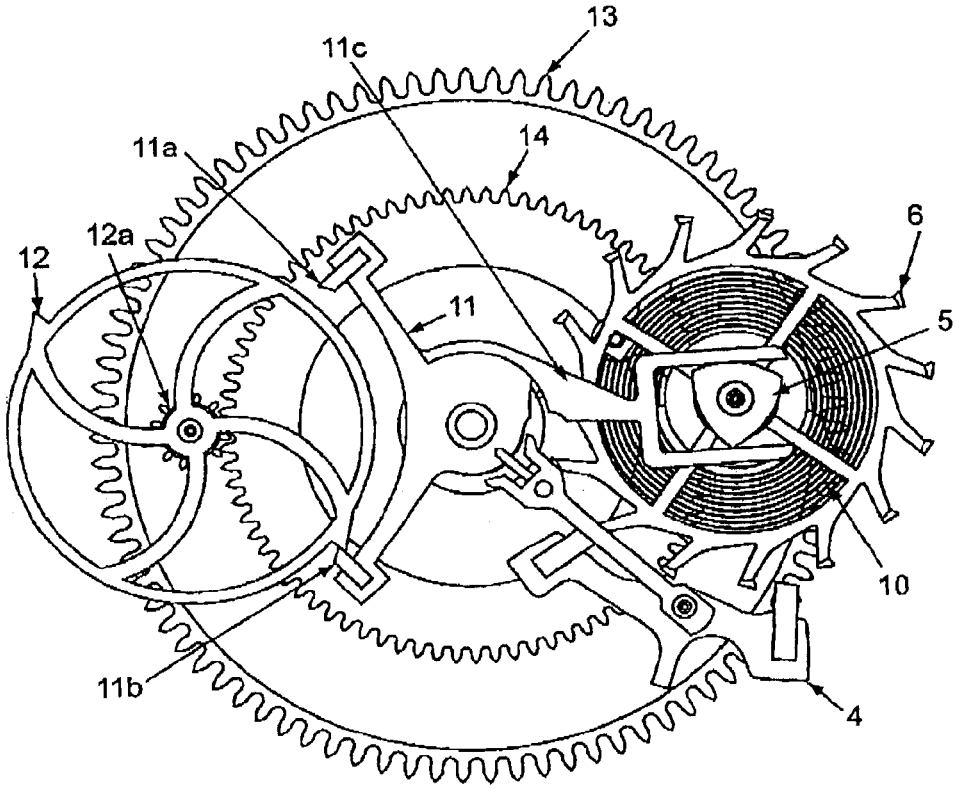
FIG. 3 shows the essential components of the device, for greater perspicuity without the Tourbillon cage in a top view as in FIG. 1
Figure 4:
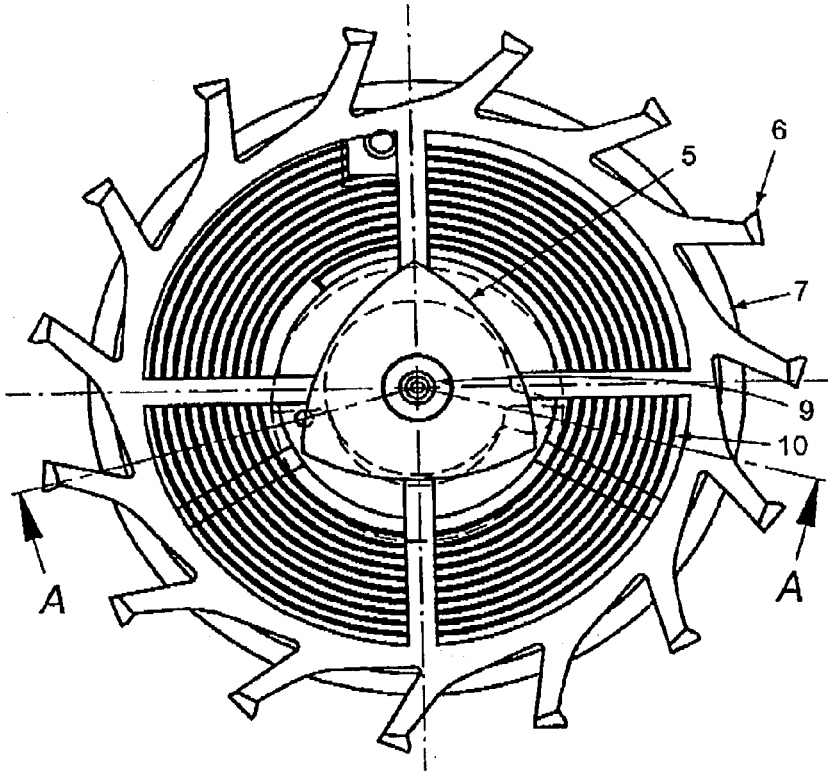
FIG. 4 is a plan view of the major component of the constant-force device.

It can be seen from FIG. 2 or FIG. 3 that the Reuleaux cam 5 is part of a further unit of the constant-force device which again is eccentrically mounted in the Tourbillon cage 1, and which in particular is not concentric with the stop wheel 12. The axle of this unit that is shown as a top view, as a sectional view and as a functional representation in FIGS. 4 to 6 consists of the escape wheel shaft 9 that is rotatably embedded in the Tourbillon cage 1 and at which is fixed the Reuleaux cam 5 in the upper portion, and an escape wheel 6 therebeneath. This escape wheel 6 has the teeth shaped as usual to this end, and thus allows the movement of the escape wheel to be blocked or released by a first anchor 4 which as it were sits on top of the Tourbillon cage 1 and is controlled by balance wheel 2, this first anchor having two anchor pallets engaging in alternation with the teeth of the escape wheel.

In the lower portion of the escape wheel shaft 9, a tension ring pinion 8 is mounted rotatably around this shaft, and a tension ring 7 is fastened at this pinion. The tension ring pinion 8 is supported by a sleeve 26, and similarly to the stop wheel pinion 12*a* is engaged with the fixed wheel of seconds 14, which when integrating a constant-force device according to the present invention into a Tourbillon mechanism may define the possible relative positions of these two elements.

Figure 5:
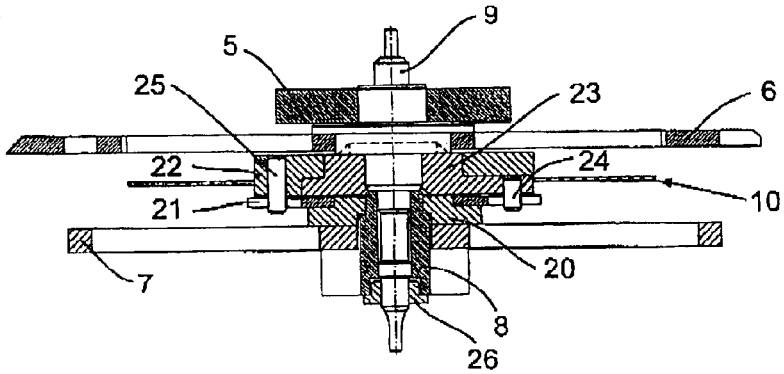
FIG. 5 is a sectional view of the constant-force device taken along the line A—A of FIG. 4 in order to show in detail the force balance mechanism integrated there.
Figure 6:
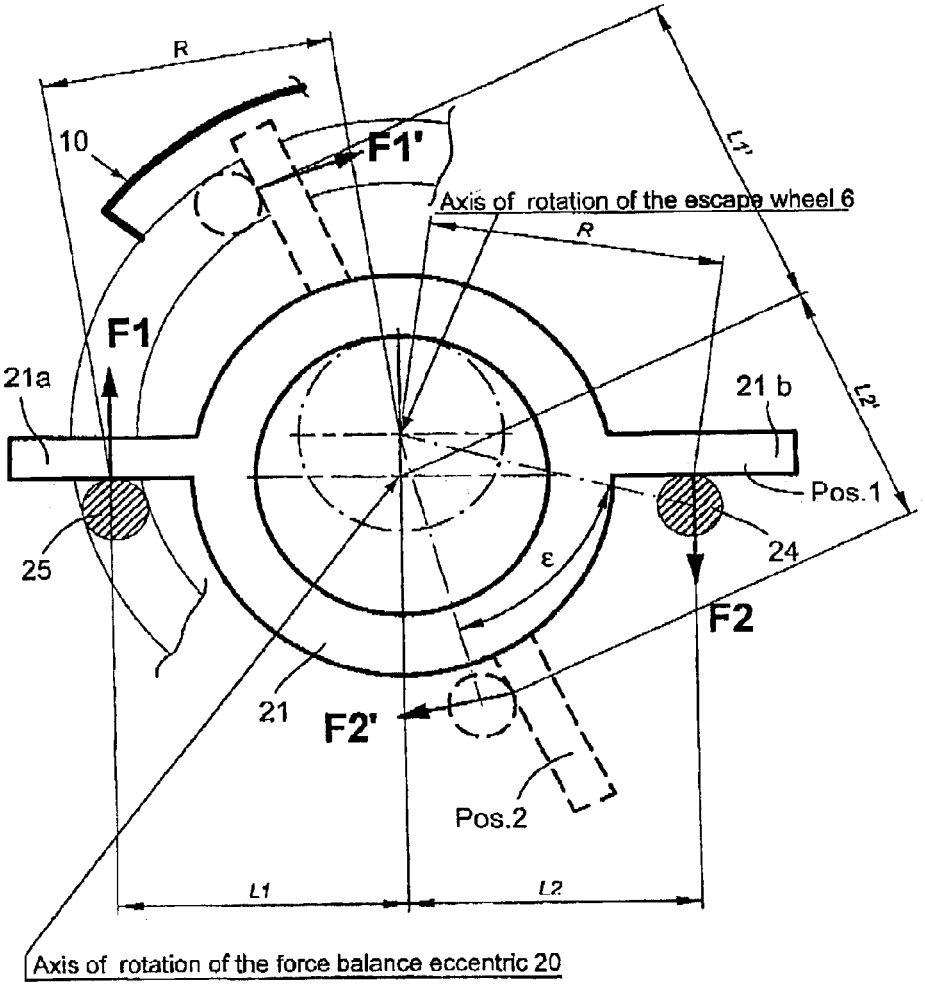
FIG. 6 schematically illustrates the functioning of the force balance mechanism.

Between the escape wheel 6 and the tension ring 7, a helical spring 10 of the constant-force device is positioned, as can be seen in particular from FIG. 5, this being realized through a particular force balance mechanism. This force balance mechanism has a force balance eccentric 20 fixed on the side of tension ring 7 that is opposite to the escape wheel 6, the axis of this eccentric being shifted parallel relative to the axis of escape wheel shaft 9 and to the axis of rotation of the tension ring pinion 8 that is identical with the latter. Rotatably supported around this eccentric 20 which can be realized in different shapes, and particularly in shapes that are not necessarily circular, there is a force balance disk 21 which in the present example includes two oppositely positioned arms serving as the working points (21*a*, 21*b*), which disk of course could have quite a different though functionally identical shape. Above this disk there is a fixed collet 23 fastened to the escape wheel shaft 9 and holding a free end of the helical spring 10. The other free end of this spring is fastened to a mobile collet 22 attached rotatably about the fixed collet 23 and thus about the axis of escape wheel shaft 9. Both the fixed collet 23 and the mobile collet 22 have a pin 24, 25 projecting downward in the direction of the force balance disk 21 from a hole situated at the extreme edge of each collet, here at the same distance from the axis of the escape wheel shaft 9. These two pins 24 and 25 are positioned so as to be on the same side of a plane that passes through the line given by the two arms of force balance disk 21 and is normal to this disk, and to cooperate with these arms 21*a*, 21*b*.

Apart from the conceptual design, one can also illustrate in an examplary fashion the functioning of a device of this kind while referring to the embodiment represented. The balance wheel 2 is driven by the pre-tensioned helical spring 10, and returned by the second helical spring 3. After every fifth half-oscillation of balance wheel 2—this number of half-oscillations is determined by the number of teeth of the escape wheel and can certainly be selected differently—the stop wheel 12 and the cage 1 of the Tourbillon mechanism are released via the Reuleaux cam 5 and the second anchor 11. The stop wheel 12 then turns through a certain angle that is determined by the number of its teeth, in the present case through an angle of 90°, and is then stopped by an anchor pallet of the anchor 11. Since the stop wheel and the stop wheel pinion 12*a* sit on the Tourbillon cage and since the latter is engaged with the fixed wheel of seconds 14 or with the second fixed wheel of seconds, this turning of the stop wheel 12 at the same time causes a rotation of the Tourbillon cage 1, and this in turn causes a rotation of the tension ring pinion 8 which also sits on the Tourbillon cage and is engaged with the fixed wheel of seconds 14. The resulting rotation of the tension ring 7 causes re-tensioning of helical spring 10, since on the other hand the escape wheel 6 is blocked by the first anchor 4. By repetition of this set of events after every fifth half-oscillation of the balance wheel 2, the helical spring 10 is tensioned periodically by the same amount.

The energy stored by the tensioning of this helical spring 10 can be retransmitted in the form of a torque in order to maintain the oscillations of balance wheel 2, in which case the tension will be relaxed to a minor extent, though with a perceptible effect on the desired precision, until the spring is once more re-tensioned. Therefore, energy transmission is accomplished by means of the specific force balance mechanism securing transfer of a truly constant torque. To this end the tensioned helical spring 10 attached with one end at the mobile collet 22 exerts a force on the pin 25 present in this collet 22, and this pin transmits this force as a torque via one of said arms of the force balance disk 21 to this disk. The other arm of the force balance disk 21 acts upon the pin 24 present in the fixed collet 23 and thus transmits the torque to this fixed collet 23 as well as to the escape wheel 6. The lever arms L1 and L2 for the torques applied to the two arms of the force balance disk 21 are variable, inasmuch as the axes of rotation of the escape wheel shaft 9 and of the force balance disk 21 that is supported around the force balance eccentric 20 are shifted parallel relative to each other, as can be seen from FIG. 6. By appropriate selection of the lengths of these lever arms in the different positions of force balance disk 21 as functions of the forces F1 and F2 applied there, it is possible to attain a truly constant torque at escape wheel 6 despite the loss of tension of helical spring 10 during stoppage of the entire train of gears between barrel and stop wheel 12. In the example presented in FIG. 6, this plainly means that the length L1 of the first lever arm in position 1, that is, the working point of pin 25 at one of the arms of force balance disk 21 in this position, is lengthened to the length L1' when it rotates into position 2, while the length L2 of the second lever arm, that is, the working point of pin 24 at the other arm of force balance disk 21, is shortened to a length L2'. This serves to increase the ratio L1'/L2', and compensate for the decrease of force F1 in position 1 to the force F1' because of loss of tension of the helical spring 10. One thus attains a constant force F2 during rotation, so that the torque transmitted to escape wheel 6 also is constant. This condition can be formulated mathematically by the equation $$F1/F1'=(L1'*L2)/(L1*L2)$$

which thus allows one to calculate the lever arm ratio or properties of helical spring 10 that are required, and hence the appropriate design of the force balance mechanism.

During each half-oscillation of balance wheel 2 the escape wheel 6 is released by the first anchor 4, and rotates about its own axis through an angle $\epsilon$ under the influence of the tensioned helical spring 10, just like the fixed collet 23 and the force balance disk 21, while tension ring 7 and stop wheel 12 are blocked.

During each fifth half-oscillation the stop wheel and the Tourbillon cage are released in addition. As described above, this causes the tension ring 7 to rotate through a given angle, which in the present example is 60°, and reassume its initial position relative to the escape wheel 6, giving rise to renewed tensioning of helical spring 10 by a specific amount. The full sequence of events is repeated periodically, and thus allows a constant torque to be transmitted permanently from the escape wheel 6 to balance wheel 2, as the regulating organ of the watch.

The advantages of such a device are obvious. First of all this device as described, in contrast to the traditional constant-force devices, delivers to the regulating organ of the watch a constant torque that was corrected for the loss of tension of the driving helical spring by means of the specific force balance mechanism. The force balance mechanism introduced to this end consists of only three new parts, and thus does not represent a substantial complication of the device, particularly inasmuch as little space is needed and these parts are readily arranged around the escape wheel shaft. The system moreover can be adjusted in such a way that the torque remains constant even if the pre-tension of the helical spring deviates within a certain range.

As mentioned, moreover, diverse advantages arise from the nonconcentric arrangement of the stop wheel relative to the wheel that transmits the constant torque, in the present case escape wheel 6. When the constant-force device is integrated into a Tourbillon mechanism, even the position of the stop wheel about the fixed wheel of seconds can be selected freely, and via its pinion it can also be engaged with a second fixed wheel of seconds of different diameter. The diameter and the number of teeth of the stop wheel as well as the number of teeth of the stop wheel pinion can thus be selected freely within a certain range of variation, so that the engagement of the anchor pallets can be optimized and the speed of rotation of the stop wheel can be different from that of the escape wheel. This will also result in structural advantages, for instance a simplification of access to the escapement and to the constant-force device, since the escape wheel and the stop wheel are not placed one above the other, or the moment of inertia of the Tourbillon cage can be optimized by this placement and by a lower speed of rotation of the stop wheel—in those cases where the constant-force device is integrated into a Tourbillon mechanism. Moreover, a fine adjustment system can be set up on the tension ring. As the tension ring for its truth does not require any particular tolerance, a running fit between the tension ring and the escape wheel shaft can be selected, so that the escape wheel—as in the embodiment described in detail—is solidly attached to the escape wheel shaft. This produces a minimal running clearance of the escape wheel, which thus corresponds to the clearance of a standard escapement without constant-force device. The fact that the escape wheel and the stop wheel do not have the same axle generally simplifies the conceptual design, the fabrication and the regulation of the watch.

The possibility of integrating a constant-force device of this design into a Tourbillon mechanism which has been taken into account in the embodiment described is of great interest, particularly inasmuch as in this way the complementary properties of these two systems for a precise regulation of the movement can be combined in an efficient manner. Thus, the escapement is no longer influenced by the inertia of the gears. With a design such that the stop wheel is released once every second, the mechanism can show full seconds. The beat common in a Tourbillon mechanism which occurs when the Tourbillon cage is stopped and which has a detrimental dynamic effect is strongly reduced by the tensioning of the helical spring and by introduction of the force balancing mechanism. Thus, instead of an abrupt stoppage the Tourbillon cage is decelerated in advance.

Finally, the arrangement of the axis of rotation of the second anchor in the center of the Tourbillon cage is also advantageous. In this way an influence of the anchor on the moment of inertia of the Tourbillon cage is avoided, contrary to what would be found for another placement, and the dynamics of the system is optimized.

The embodiment shown in an examplary manner is in no way limitating, insofar as the additional features shown there, such as the nonconcentric position of the stop wheel relative to the wheel transmitting the constant torque, the placement of the second anchor into the center of the rotating jig, or the integration into a Tourbillon mechanism may be omitted or may be subject to functionally identical alterations, just like the detailed design of the force balance mechanism.

What is claimed is:

1. Constant-force device comprising a stop wheel (12) attached to a stop wheel pinion **(12*a*), an escape wheel (6) attached to an escape wheel shaft (9), a tension ring (7) attached to a tension ring pinion (8), and a cam (5) attached to the escape wheel shaft (9) where the movement of the escape wheel (6) is blocked or released by two anchor pallets of a first anchor (4) and where the movement of the stop wheel (12) is blocked or released by two anchor pallets (11*a*, 11*b*) of a second anchor (11) that is controlled by a fork-shaped part of this second anchor (11) engaged with the cam (5), characterized in that it comprises a force balance mechanism securing transmission of a constant torque to the regulating organ of a watch by compensating the loss of tension of a spring (10)** that provides the driving energy.

2. Constant-force device according to claim 1, characterized in that the force balance mechanism is located between the escape wheel (6) and the tension ring (7) that is supported rotatably about the escape wheel shaft (9) by the tension ring pinion (8), and in that the force balance mechanism comprises a helical spring (10).

3. Constant-force device according to claim 2, characterized in that a force balance eccentric (20) is attached to the tension ring pinion (8) on the side of the tensions ring (7) opposite to the escape wheel (6), said eccentric defining an axis of rotation shifted in parallel relative to the axis of the escape wheel shaft (9), and a force balance disk (21) having at least two working points **(21*a*, 21*b*)** being rotatably supported on said eccentric.

4. Constant-force device according to claim 3, characterized in that said helical spring (10) of the force balance mechanism is attached with one end to a fixed collet (23) attached to the escape wheel shaft (9) and having a pin (24) projecting in the direction of the force balance disk (21), and with its other end to a mobile collet (22) that is supported rotatably about the fixed collet (23) and has a pin (25) projecting in the direction of the force balance disk (21), the two pins (24, 25) cooperating with said working points (21*a*, 21*b*) of the force balance disk (21) in such a way that the lever arm lengths of the forces exerted on these working points with the aid of the pins (24, 25) applied there, are varied as a function of the position of the force balance disk (21) rotating about the force balance eccentric (20), in such a way that the decrease of the force exerted via pin (25) of the mobile collet (22) on the force balance disk (21) that is due to the loss of tension of helical spring (10) is compensated in such a way that the torque transmitted by the force balance disk (21) via pin (24) of the fixed collet (23) to the escape wheel (6) is constant in all positions relative to the tension ring (7).

5. Constant-force device according to claim 1, characterized in that the stop wheel (12) is not concentric with a wheel transmitting the constant torque.

6. Constant-force device according to claim 1, characterized in that the device is integrated into a Tourbillon mechanism comprising a Tourbillon cage (1), a balance wheel (2), and a fixed wheel of seconds (14).

7. Constant-force device according to the preceding claim 6, characterized in that the escape wheel (6) is rotatably attached to the border of the Tourbillon cage (1) and the tension ring pinion (8) is engaged with the fixed wheel of seconds (14), in that the stop wheel (12) is attached to the border of the Tourbillon cage (1), rotatably but nonconcentrically to the escape wheel (6), and that the stop wheel pinion (12*a*) is engaged with the fixed wheel of seconds (14) or with a second fixed wheel of seconds attached concentrically to said wheel, and in that the balance wheel (2) controls the movements of the first anchor (4) of the constant-force device.

8. Constant-force device according to claim 6, characterized in that the axis of rotation of the second anchor (11) is arranged in the center of the Tourbillon cage (1).

9. Constant-force device for a watch, comprising an escape wheel attached to an escape wheel shaft;

a stop wheel attached to a stop wheel pinion, the stop wheel being non-concentric with the escape wheel;

a tension ring attached to a tension ring pinion;

a cam attached to the escape wheel shaft;

two anchor pallets of a first anchor blocking and releasing movement of the escape wheel;

two anchor pallets of a second anchor blocking and releasing movement of the stop wheel;

a fork-shaped part of the second anchor being engaged with the cam and controlling the fork-shaped part; and a force balance mechanism securing transmission of a constant torque to a watch regulating organ by compensating a loss of tension of a spring that provides the driving energy, the escape wheel transmitting the constant torque.

10. Constant-force device for a watch with a watch regulating organ, comprising:

a tensioned spring providing driving energy to a watch regulating organ;

a stop wheel attached to a stop wheel pinion;

an escape wheel attached to an escape wheel shaft;

a tension ring attached to a tension ring pinion;

a cam attached to the escape wheel shaft;

two first anchor pallets, of a first anchor, blocking and releasing movement of the stop wheel;

a fork-shaped part engaging with the cam to control the second anchor; and a force balance mechanism compensating a loss of tension of the spring to secure transmission of a constant torque to the watch regulating organ.

11. The device of claim 10, wherein, the force balance mechanism provides variable lever arms compensating for diminishing force delivered form the spring experiencing diminishing tension between two actions of spring re-tensioning, the compensation regulating in transmission of the constant torque to the watch regulating organ.

* * * * *